United States Patent [19]

Johenning et al.

[11] Patent Number: 4,750,959

[45] Date of Patent: Jun. 14, 1988

[54] WATERBED MATTRESS WITH BAFFLE CHAMBERS

[75] Inventors: John B. Johenning, Los Angeles; Charles P. Hall, Santa Rosa, both of Calif.

[73] Assignee: Advanced Sleep Products, Carson, Calif.

[21] Appl. No.: 808,994

[22] Filed: Feb. 5, 1986

Related U.S. Application Data

[62] Division of Ser. No. 364,534, Apr. 1, 1982, Pat. No. 4,577,356.

[51] Int. Cl.[4] ..... A47C 27/08; B32B 31/20

[52] U.S. Cl. ..... 156/145; 5/451; 156/196; 156/252; 156/292; 156/308.4; 264/510; 264/571

[58] Field of Search ..... 156/62.2, 78, 252, 292, 156/308.4, 145, 196; 5/450, 451; 264/510, 571, 257

[56] References Cited

U.S. PATENT DOCUMENTS

| | | | |
|---|---|---|---|
| 3,748,669 | 7/1973 | Warner | 5/450 |
| 4,204,289 | 5/1980 | Fogel | 5/451 |
| 4,221,013 | 9/1980 | Eschevarria | 5/451 |
| 4,247,962 | 2/1981 | Hall | 5/451 |
| 4,292,702 | 10/1981 | Phillips | 5/451 |
| 4,296,510 | 10/1981 | Phillips | 5/451 |
| 4,301,560 | 11/1981 | Fraige | 5/451 |
| 4,325,152 | 4/1982 | Carpenter | 5/451 |
| 4,329,748 | 5/1982 | Finkelstein | 5/451 |
| 4,345,348 | 8/1982 | Hall | 5/451 |
| 4,399,575 | 8/1983 | Hall | 5/450 |
| 4,422,194 | 12/1983 | Viesturs et al. | 5/451 |
| 4,475,257 | 10/1984 | Phillips | 5/450 |
| 4,517,691 | 5/1985 | Phillips | 5/450 |
| 4,523,343 | 6/1985 | Fraige | 5/451 |
| 4,551,873 | 11/1985 | Hall | 5/450 |

FOREIGN PATENT DOCUMENTS

| | | |
|---|---|---|
| 1091368 | 12/1980 | Canada . |
| 1094234 | 1/1981 | Canada . |
| 1103817 | 6/1981 | Canada . |
| 1128678 | 7/1982 | Canada . |

OTHER PUBLICATIONS

Advertisement for Ultralite Mattress by Ultratherm, 1982.

Advertisement for the Max and Gold Max Mattress by Wavecrest, 1982.

Advertisement for Olympus Mattress by American National, 2/80.

Advertisement for Maxum Mattress by Wavecrest, Flotation Sleep Industry, Dec., 1981, pp. 48–49.

*Primary Examiner*—Michael Wityshyn

*Attorney, Agent, or Firm*—Sheldon & Mak

[57] ABSTRACT

A waterbed mattress has a baffle structure that comprises a horizontally extending pad of buoyant material with a plurality of chambers depending therefrom. The chambers can be hemi-spheroidal. The chamber walls having water metering holes therethrough.

19 Claims, 3 Drawing Sheets

WATERBED MATTRESS WITH BAFFLE CHAMBERS

CROSS-REFERENCES

This application is a division of U.S. patent application Ser. No. 364,534, filed Apr. 1, 1982, now U.S. Pat. No. 4,577,356.

This application is related to U.S. patent application Ser. No. 250,733 filed Apr. 3, 1981 by Charles P. Hall now U.S. Pat. No. 4,399,575, which is incorporated herein by this reference.

BACKGROUND

The present invention relates to waterbed mattresses, and in particular waterbed mattresses having a baffle structure.

Waterbed mattresses having baffles are well known. For example, waterbed mattresses having a horizontal baffle are described in U.S. Pat. No. 4,247,962 issued to Charles P. Hall and application Ser. No. 95,214 filed on Nov. 19, 1979 by Charles P. Hall, now U.S. Pat. No. 4,345,348. Waterbed mattresses using fibrous material for a baffling effect are known, Waterbed mattresses having a plurality of cells or apertured chambers are described in U.S. Pat. Nos. 4,221,013 to Echavarria and 4,204,289 to Fogel. Advantages are claimed for each of these baffle structures. For example, the Hall horizontal baffle has been shown to reduce wave motion faster than a vertical baffle. The fiber baffle is claimed to have advantages compared to a foam baffle. Chambers are claimed to have a wave reduction feature because a wave entering the chamber only slowly exits through the apertures.

A disadvantage of waterbed mattresses having a fiber baffle is that the fiber is difficult to drain when emptying the mattress. A difficulty with the Fogel cell structure is that it is complex to manufacture.

SUMMARY

The present invention is directed to a waterbed mattress which contains a novel baffle structure that is very effective in reducing wave motion in the mattress, that is easy to manufacture, and that allows the mattress to be easily drained. The mattress of the present invention has an enclosing structure that comprises a horizontally extending top wall, a horizontally extending bottom wall, and side walls.

The novel baffle structure comprises a plurality of side-by-side chambers, which can be hemi-spheroidal in shape. The chamber wall comprises a planar wall and a depending wall. The depending wall is constituted of a material denser than water. The planar wall is proximate to and substantially parallel with the top wall. There are a plurality of metering holes through the depending wall of each chamber for passage of water into and out of the chamber. The metering holes control the rate at which water can move into and out of one of the chambers when the top wall of the mattress is disturbed, such as by a person sitting on the mattress. By varying the ratio of the surface area of the metering holes to the volume of a chamber, the apparent firmness of the mattress can be controlled.

Preferably, the ratio of the cross-sectional surface in area square inches of the metering holes of a chamber to the volume in gallons of water of the chamber is from about 0.2 to about 5, more preferably from about 0.5 to about 2.5, and most preferably about 1, to provide an apparent firmness satisfactory to most consumers.

The greater the volume of the chambers compared to the volume of the mattress, the more wave reduction that is realized. Thus, preferably the volume of the chambers is at least about 40% of the volume of the mattress.

In a preferred version of the invention, the baffle structure is formed by a horizontally extending buoyant pad with a plurality of chambers depending therefrom. The pad can have a horizontal extent corresponding generally to the sleeping surface of the mattress. The baffle structure can also include a horizontally extending layer of a porous mass of bound together fibers between the buoyant pad and the top wall to give the mattress a softer feel.

The mattress of the present invention is easily manufactured. The baffle structure can be formed from only two sheets of material, a horizontally extending pad and a polymeric film that has been vacuum-formed to provide the depending walls of a plurality of side-by-side chambers. The pad and the vacuum-formed sheet can be secured together by adhesive or a heat sealing.

Preferably the chambers are in a side-by-side staggered configuration so that a person lying on the mattress is always above at least one of the chambers. Thus a user of the mattress is always supported by the horizontal pad, and whenever a user rolls on the mattress, he is at least temporarily cushioned by the chambers.

DRAWINGS

These and other features, aspects, and advantages of the present invention will become better understood with reference to the following description, appended claims, and accompanying drawings where:

Figure 1:
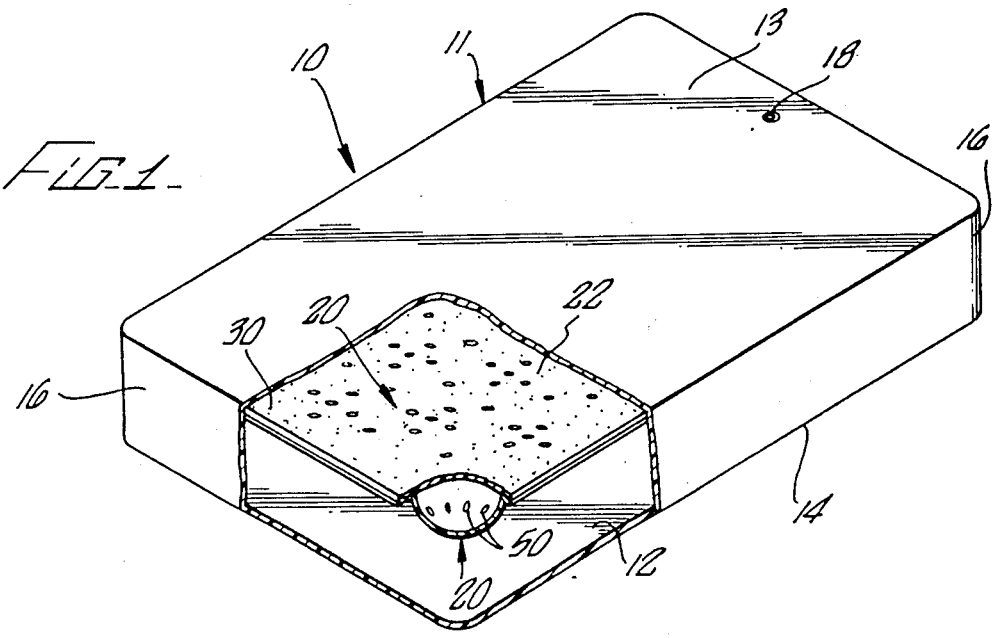
FIG. 1 is a perspective view, partly broken away, of a waterbed mattress according to the present invention.
Figure 2:
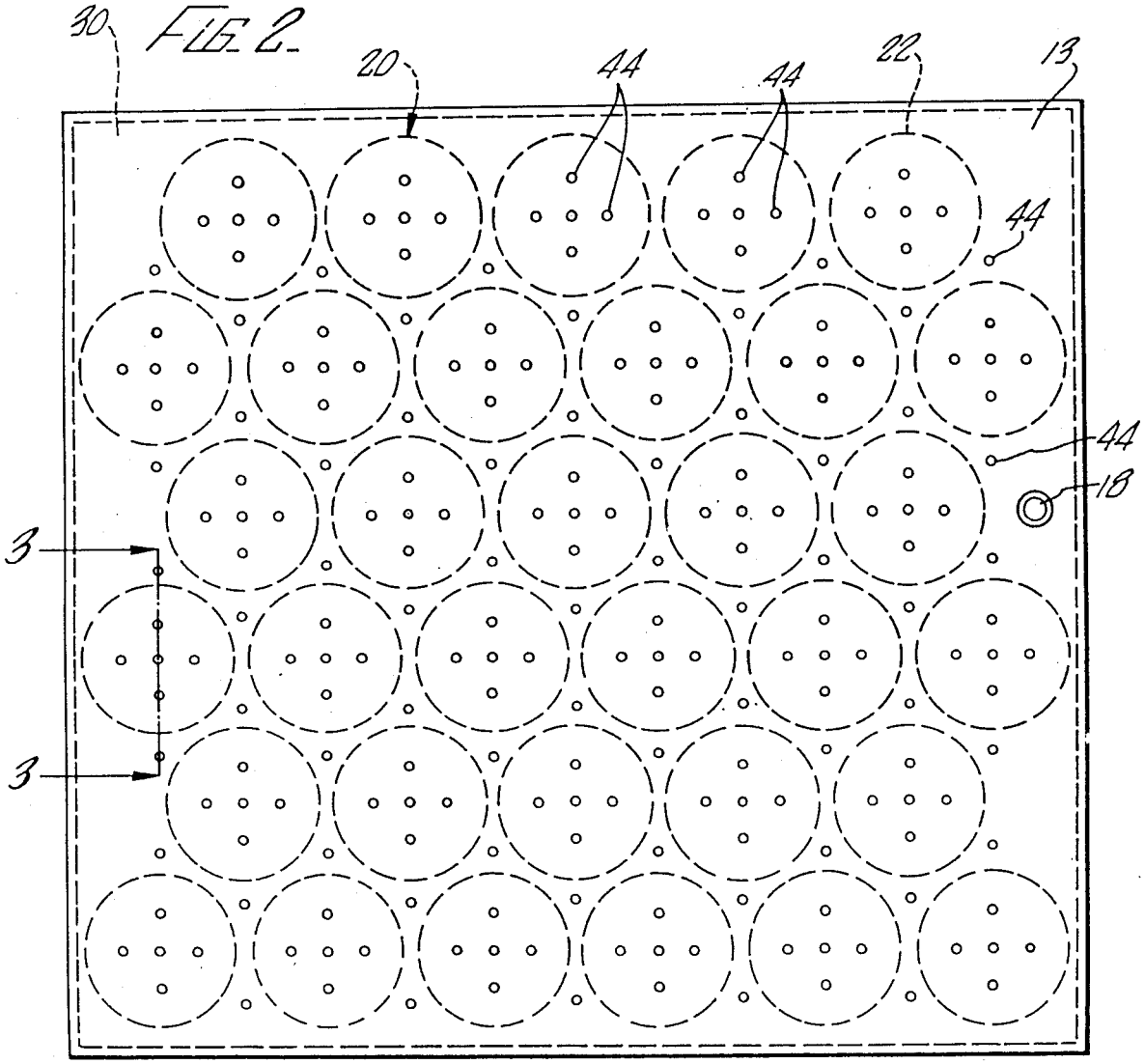
FIG. 2 is a top plan view of the waterbed mattress of FIG. 1.
Figure 3:
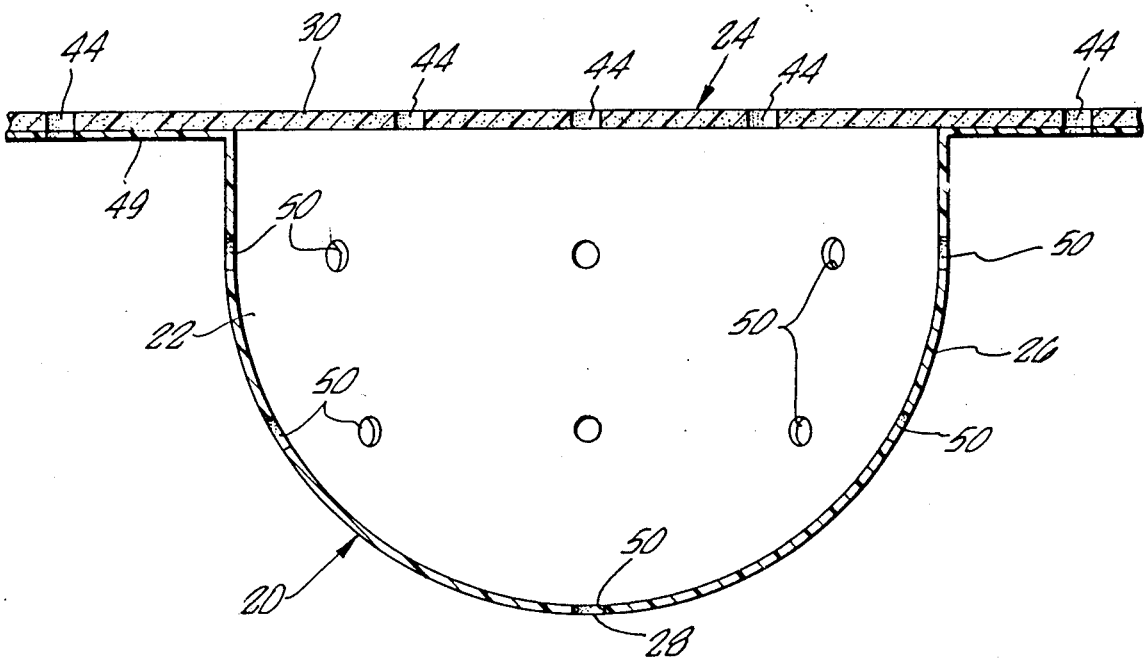
Figure 4:
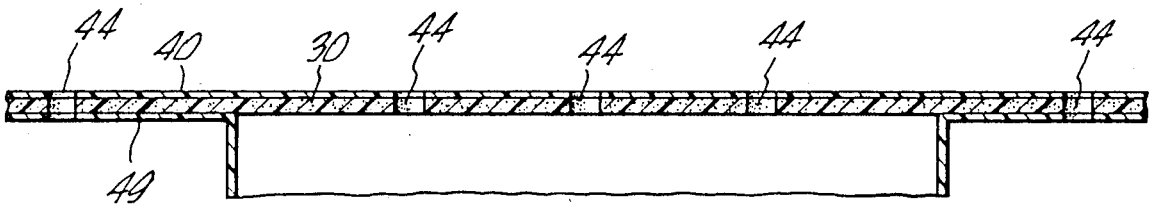
Figure 5:
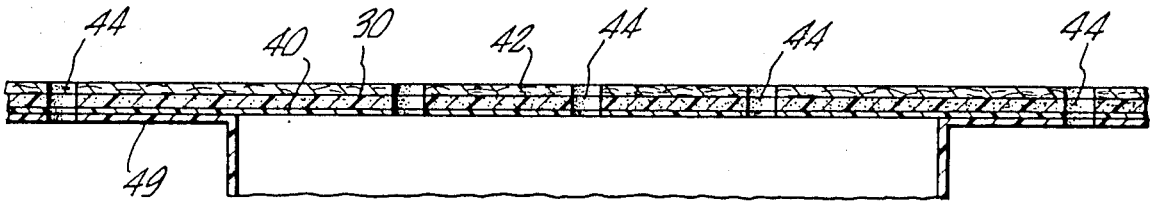
Figure 6:
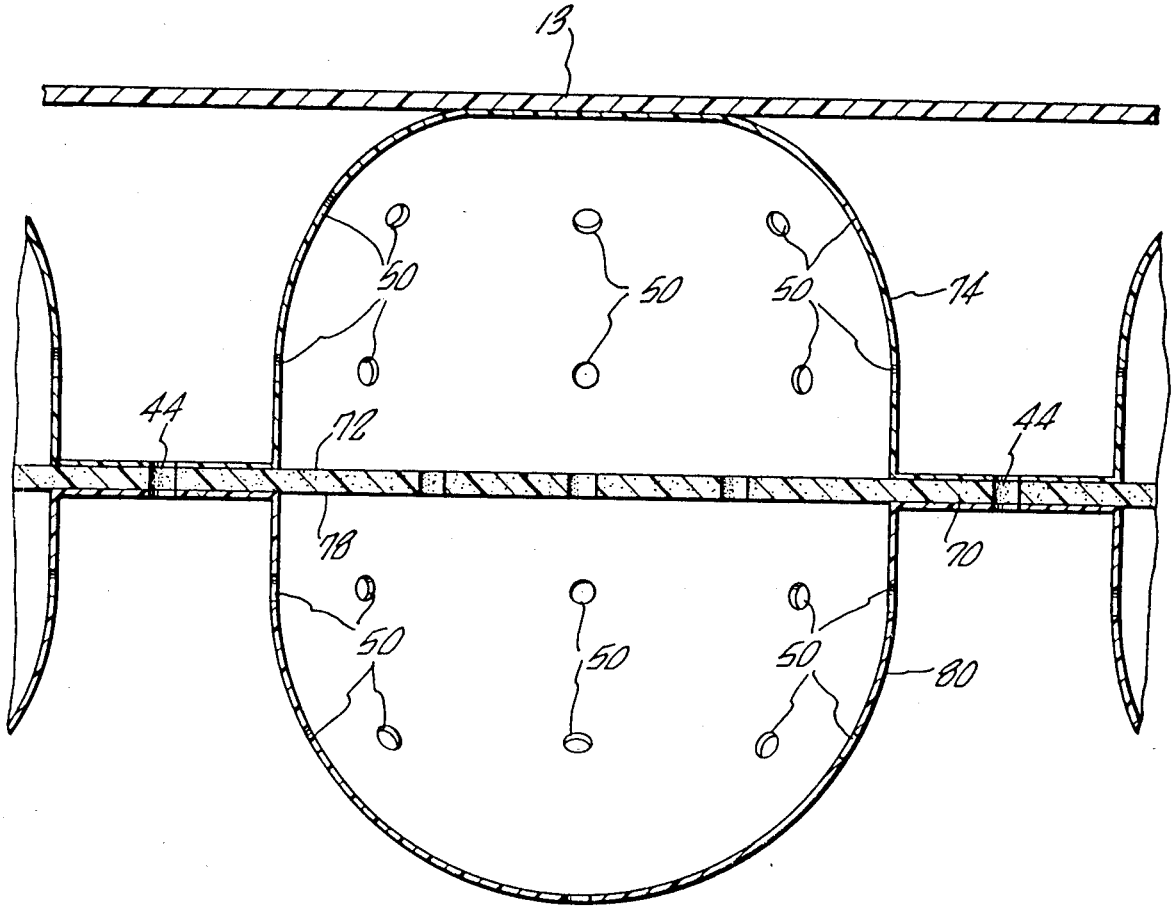

FIG. 3 is a horizontal sectional view of a chamber of the baffle structure of the mattress of FIGS. 1 and 2 taken on line 3—3 in FIG. 2; and FIGS. 4, 5, and 6 are partial horizontal sectional views similar to that of FIG. 3 of a baffle structures of alternate versions of the present invention.

DESCRIPTION

With reference to FIG. 1, the present invention is directed to a waterbed mattress 10 that has less wave-like motion at the surface of the mattress than conventional waterbed mattresses. This novel waterbed mattress has an enclosing structure 11 containing a body of water 12. The enclosing structure is fabricated of a flexible material and comprises a top wall or surface 13, a bottom wall or surface 14, and side walls 16. The enclosing structure can be made of a flexible material such as polyvinylchloride or polyethylene. The top surface 13 is adapted for receiving persons in sitting and reclining positions and is referred to as the sleeping surface of the mattress. The enclosing structure can be formed in any suitable manner, for example, by bonding two planar sheets together along their peripheries or by bonding two upstanding sheets between the edges of the top and bottom walls to form a contour or fitted structure. Water is introduced into and removed from the mattress through a valve 18 located in the top wall 13.

With reference to FIGS. 1–3, the waterbed mattress 10 is provided with a novel baffle structure 20 within the enclosing structure. The baffle structure 20 is unattached to the enclosing structure, i.e., it can float freely in the mattress when the mattress is filled with water, and is not anchored to the side, bottom, or top walls. This avoids the need for welds between the enclosure and the baffle structure. Such welds can be a source of leaks in a mattress.

In general, the novel baffle structure comprises a plurality of side-by-side chambers. The chamber wall comprises a top or planar wall that is bouyant and depending side walls constituted of a material denser than water. The opposing forces caused by the bouyant top wall and the sinking depending wall result in each chamber achieving its desired configuration without either "hanging" a chamber from the top wall of the mattress or "anchoring" the chamber to the bottom wall of the mattress.

There is at least one metering hole through the depending wall of each chamber for passage of water into and out of the chamber. The chambers can have substantially any configuration, including cylindrical, pyramidal, cubic, rhomboidal, and the like.

As shown in the figures, preferably the baffle structure comprises a plurality of hemi-spheroidal chambers 22. By the term "hemi-spheroidal" there is meant a structure that constitutes about one-half of a spheroid. A vertical cross-section of one of the chambers of the present invention can be a portion of an ellipse, as shown in FIG. 3, or can be a portion of a circle. The hemi-spheroidal chamber can be hemi-spherical, i.e., "hemi-spheroidal" chambers include hemi-spherical chambers.

With reference to FIGS. 2 and 3, each chamber or cell 22 comprises a planar wall 24 and a depending doublecurved convex wall 26. The planar wall 24 is proximate to and substantially parallel with the top wall 13 of the enclosing structure. The apex 28 of the convex wall 26 is proximate to the bottom wall 14 of the enclosing structure.

The planar walls 24 of all of the chambers 20 can be formed from a buoyant material. Individual pieces of buoyant material can be used for each chamber, or preferably, a single pad 30 can be used for forming the top planar walls 24 of all of the chambers 22. The pad 30 is preferably formed of a closed-cell polymeric foam to avoid air retention when filling the mattress with water and to avoid water retention when draining the mattress. The polymeric foam can be polyethylene foam, polyurethane foam, or styrofoam$_{TM}$. The pad 30 can be sufficient buoyant that it is proximate to the top wall 13 of the enclosing structure. It is not necessary that the pad 30 be touching the top wall of the enclosing structure.

Preferably the pad 30, and for that matter, preferably the entire baffle structure 20, have a horizontal extent corresponding generally to the sleeping surface of the mattress for effective reduction of the wave motion. In a king-sized mattress having a sleeping area measuring 84×72 inches, the baffle structure can have a length of 76 inches and a width of 64 inches. It is important that the baffle structure has a large horizontal extent to obtain adequate dampening of the wave-like motion of the water in the waterbed. To obtain adequate dampening, preferably the pad 30 has a horizontal extent such that its top surface area is equal to at least about two-thirds of the surface area of the sleeping surface. More preferably the horizontal extent of the pad is equal to at least about three-quarters of the surface area of the sleeping surface, and most preferably is coextensive with the sleeping surface.

If desired, more than one baffle structure 20 in side-by-side relation can be used so that the total surface area of the baffles is equal to at least about two-thirds of the surface area of the sleeping surface. Preferably only one baffle structure is used for ease of fabrication, ease of folding of the mattress, and to insure that the chambers remain in a laterally fixed position relative to each other.

The convex wall 26 of the chambers can be formed of individual pieces of polymeric film. Preferably, all of the chambers for a mattress are formed together such as by vacuum forming a single sheet of polymeric film. The convex walls can be fabricated of a material such as polyvinylchloride, polyethylene, or Surlyn$_{TM}$. The film needs to have a density greater than that of water so that the convex walls 26 of the chambers sink towards the bottom wall 14 of the mattress.

This film used for the convex wall 26 has a specific gravity of 1.2. High density fillers for the film can be used, such as titanium dioxide and iron oxide.

A suitable high density film having a specific gravity greater than one can be formed from a blend of 50 lbs. litharge available from Associated Lead, Philadelphia Pa. and 150 lbs. of low density polyethylene available from Exxon under Catalog No. LD-501 or Arco under Catalog No. 1OOOF.

In a preferred version of the present invention, the pad 30 is formed of polyethylene foam and the convex walls 26 are formed of polyethylene film. This allows the pad and film to be attached to each other by heat sealing.

An advantage of using polyethylene to form the chambers is that it need not contain plasticisers which can be leached by water out of the film, thereby adversely affecting the film properties.

In an alternate version of the present invention as shown in FIG. 4, there is a sheet of film 40 secured to the top surface of the pad 30. The sheet 40 can be formed of a polymeric material such as polyvinylchloride or polyethylene. It is substantially co-extensive with the pad 30.

In the version of the invention shown in FIG. 5, the planar walls 24 comprise the pad 30 and the film 40, with the film 40 below the pad 30. The planar walls 24 also comprise a fibrous layer 42 comprising a porous mass of bound together fibers on the top surface of the buoyant pad 30. Preferably the fibrous layer 42 has a horizontal extent substantially coincident with and has coinciding edges with the buoyant pad 30.

A preferred material for the fibrous layer 42 is 45 denier non-woven polyester fibers bound together with acrylic resin, which is available from E. R. Carpenter of La Mirada, Calif., This material is foldable so that the mattress can be stored easily. Because of the porosity of the fiber, the material is sufficiently porous that it is possible to pour water right through it. A particular advantage of the material available from E. R. Carpenter is that it is produced by an air-lay process, where the fibers are both vertically and horizontally oriented before they are bound together with resin. Because the fibers are vertically oriented, the layer 42 is stronger and has more loft per pound of fiber than if the fibers were only horizontally oriented.

With reference to FIG. 6, the baffle structure can comprise a pad 70 of material which may or may not be buoyant. Secured to the top surface 72 of the pad is a plurality of upper rising chambers 74 constituted of a material less dense than water. Secured to the bottom wall 78 of the pad 70 are a plurality of lower sinking chambers 80 constituted of a material denser than water. Both the upper chambers 74 and lower chambers 80 have metering holes 50 and the pad is provided with air holes 44. Although in FIG. 6 the mattress is shown as having the upper and lower baffles of the same shape and size, the upper and lower baffle chambers can be of sizes different from each other, and of shapes different from each other. Moreover, the upper and lower chambers need not be stacked directly above each other, but can be staggered.

In the preferred version of the present invention, the planar walls of the chambers are formed by a single pad 30. An advantage of this configuration is that the lateral spatial relation between the chambers is fixed, i.e., one chamber cannot move below another chamber, and the chambers cannot bunch up at one side of the mattress.

When reference is made herein to the chambers "depending" from or being "secured" to the pad 30, it is not necessary that the chambers be directly attached to the pad. As shown in FIG. 5, the chambers can be separated from the pad 30 by a film 40.

If desired, a plurality of individual pads can be used in place of the buoyant pad 30 and/or a plurality of individual layers of fiber can be used in place of the layer 42. However, this version is less desirable because it is more complicated to manufacture and the relative lateral location of the chambers is not fixed.

As shown in FIG. 3, the film used to form the convex wall 26 of the chamber has a top circumferential rim or flange 49 that is attached such as by welding or an adhesive to the pad 30.

As best shown in FIG. 2, the top planar wall 24 of each chamber has a plurality of air holes 44 therethrough. There are also air holes through the pad in the regions where the pad does not form part of the planar wall of the chambers, i.e., in the regions between adjacent chambers. As shown in FIGS. 3–6, these holes 44 extend all the way through the entire top planar surface of the baffle structure 20. The purpose of these holes 44 is to insure that air can escape from the mattress when it is filled with water.

The particular size or shape of the air holes 44 are not critical, as long as adequate air removal from the mattress can attained. As shown in FIG. 2, the holes 44 can be in a cross pattern comprising five ½" holes in the planar wall 24 of each chamber, with an additional ½" hole between each pair of adjacent chambers.

The baffle structure also comprises a plurality of metering holes or apertures 50 through the convex wall 26 of the chambers. These metering holes allow water to move into and out of the chambers in response to hydraulic pressure on the chambers, which can result from a person moving or sitting on the sleeping surface of the mattress.

The metering holes 50 are placed completely around the convex wall 26. For example, as shown in FIG. 3, there can be 17 metering holes 50 for each chamber. There can be one metering hole at the apex 28 of the chamber. The other 16 metering holes are in two parallel rows, one row above the other, each row consisting of eight metering holes 50 spaced equi-distant from each other circumferentially around the convex wall 26, i.e., the holes in each row are spaced 45 degrees from each other.

It is important that the metering holes 50 be spaced circumferentially around the convex wall and also be vertically spaced apart on the convex wall. By having the metering holes in substantially all portions of the convex wall, when hydraulic pressure is placed on a chamber, water can escape from the chamber in substantially all directions. This dissipates the force of the water in all directions and helps avoid formation of wave motion in the mattress. An advantage of the chambers being hemi-spheroidal rather than cylindrical or box-shaped is that at least a portion of the water pressure is directed downwardly towards the bottom wall. With a cylindrical chamber, substantially all of the water escapes in a horizontal direction, which can contribute to wave motion in the mattress. Any holes in the bottom of a cylindrical chamber are blocked when the chamber bottoms out, which can occur when a person lies or sits on the mattress above the chamber.

It is desirable that a large portion of the water in the mattress be contained in chambers for minimizing wave motion. Thus, preferably the volume of the water in the chambers comprises at least about 40% of the total volume of water in the mattress.

The ratio of the total cross-sectional surface area in square inches, S, of the metering holes for at least one of the chambers, to the volume gallons, V, of the chamber affects the apparent firmness of the mattress. The larger the ratio of S:V, the faster water can move out of or into a chamber, and the less firm a mattress feels. The smaller the ratio S:V, the slower water can move out of or into a chamber, and the firmer a mattress feels. Preferably the ratio of S:V, for at least a portion of the chambers is from about 0.5 to about 2.5, and more preferably it is about 1 to achieve a mattress of acceptable comfort. For example, there can be 17 metering holes for chambers having a volume of 2.93 gallons, each hole being ½" in diameter, to give a total surface area of 3.3 square inches. This gives an S:V ratio of about 1.1.

The metering holes need not be circular in shape. For example, they can be slits or can have flaps. When reference is made to the cross-sectional surface area of a metering hole, there is meant the cross-sectional surface area of the hole when pressure is exerted on a chamber so that water is passing out of the metering hole.

With reference to FIG. 2, the chambers for a king size mattress can be provided in six rows, the first, third and fifth rows each having six chambers, and the second, fourth, and sixth rows each having five chambers. Thus, the chambers are in a staggered or a "nestled" configuration to maximize the number of chambers that can be used. There is no chamber directly below the valve 18. The chambers can be of about 8 inches in height, which is about equal to the height of a waterbed when filled, and can have a planar wall with a diameter of about 12 inches.

Preferably the chambers are nestled or staggered so that when a person lies on the mattress, the person is located above at least one of the chambers, and preferably a plurality of chambers. Thus, the dampening and cushioning of the chambers is realized whenever a person initially lies down on the mattress, or rolls over. Therefore, there are no furroughs or grooves into which a person can roll when sleeping on the mattress.

In this preferred staggered configuration, all straight lines drawn across the top surface of the mattress between two of the side walls of the mattress, where at least a portion of the line is at least one foot from all of the side walls of the mattress, is above at least one chamber. The line can extend between the head and foot of the mattress, the head and a side, the foot and a side, or the two sides. As shown in FIG. 2, this can be achieved by having at least one of the chambers surrounded by six chambers, with the chambers almost touching and the chambers within one foot of the sides, head and foot of the sleeping surface of the mattress.

The baffle structure 20 is easy to fabricate. It can be formed from only two elements. The first element is a pad 30 which can be cut from a large layer of material into the desired configuration. The air holes 40 are cut through the pad. The second element is a sheet of polymeric material through which the metering holes are cut, and which is then vacuum-formed to produce the chambers. Then these two elements are secured together, such as by heat-sealing or an adhesive.

The baffle structure 20 and the waterbed mattress 10 having the baffle structure 20 have significant advantages. For example, the baffle structure 20 is free floating and is not secured to the enclosing structure. This eliminates the welds required for anchoring which can be a source of water leaks. In addition, stress caused on the waterbed mattress resulting from anchoring is eliminated.

The waterbed mattress 10 feels firmer than a waterbed mattress containing no baffles. A portion of the firmness is provided by the pad serving as a horizontal baffle. Another portion of the firmness is provided by the chambers. The chambers provide an apparent resistance to rolling over on the mattress. However, once water is metered out of the chambers onto which a person rolls, and water moves into the chambers from which the person rolls, then the pad by itself provides the firmness that is felt.

A further advantage of the baffle structure 20 is that it can be used with mattresses which are incapable of having baffles requiring anchoring to the enclosing structure.

Another advantage of the baffle structure 20 is that it combines the advantages of a horizontal baffle, individual chambers for the water, and a fibrous material. Thus, wave motion can be dissipated by the fibrous material which provides a horizontal baffle structure, the buoyant pad which provides a horizontal baffle structure, and the chambers which serve to insulate one portion of the water in the mattress from wave motion in other portions of the mattress and which also serve to dissipate the hydraulic pressure of the water.

As noted above, an advantage of the hemi-spheroidal structure is that at least a portion of the water pressure is dissipated downwardly rather than horizontally. A further advantage of the hemi-spheroidal structure is that there is substantially no delay between pressure being exerted on a chamber and water flowing out of the chamber. With the hemi-spheroidal shape, the walls of the chamber are substantially fully expanded, and thus, there is little lag time as the chamber walls further expand. With a cylindrical chamber, the walls of the chamber tend to expand to a spherical configuration and bulge before water flows out of the chamber.

Another advantage of the hemi-spheroidal chambers compared to a cylindrical chamber is that the holes at the bottom of a cylinder are closed by the bottom wall of the mattress when someone sits on the mattress. With a hemi-spheroidal chamber, only the hole at the apex is closed, while the other holes, including the lower row of holes, are not closed.

Another advantage of a hemi-spheroidal chamber is that good heat transfer occurs between the water at the bottom and the water at the top of the mattress because only a small portion of the water at the bottom portion of the mattress, which is closest to the heater, is enclosed by chambers.

In the version of the invention where the mattress contains fibrous layer, substantially less fibrous material is used than in mattresses that rely principally upon fiber for wave reduction. Thus, the mattress of the present invention is easier to drain than mattresses containing large amounts of fibrous material.

While the present invention has been described in considerable detail with reference to certain preferred versions thereof, other versions are possible. For example, the baffle structure need not be provided or sold as an integral part of an existing mattress. In addition, the chambers can be of different sizes and shapes. Therefore, the spirit and scope of the appended claims should not necessarily be limited to the description of the preferred versions contained herein.

What is claimed is:

1. A method for forming a baffle structure for a waterbed mattress, the baffle structure comprising a laterally extending pad and a plurality of chambers depending from the pad, the method comprising the steps of:

(a) cutting a layer of material to form a laterally extending pad having a length and width less than the length and width of the waterbed mattress into which the pad is to be placed, the pad being sufficiently buoyant to float in water and being constituted of buoyant foam;

(b) vacuum forming a sheet of polymeric material denser than water to form a plurality of hemi-spheroidal chambers;

(c) forming at least one metering hole through the walls of at least a portion of the chambers for passage of water out of the chambers; and (d) securing the pad and the vacuum-formed sheet together with the chambers being capable of depending downwardly from the pad;

wherein the buoyant pad has sufficient buoyancy that the baffle structure floats in a waterbed mattress.

2. The method of claim 1 in which the pad is constituted of polyethylene less dense than water and the polymeric sheet is constituted of polyethylene denser than water, and the step of securing comprises heat sealing the pad and the vacuum-formed sheet together.

3. The method of claim 1 in which the baffle structure includes a polymeric film between the pad and the vacuum-formed sheet, and the step of securing comprises heatsealing the pad, film, and vacuum-formed sheet together.

4. The method of claim 1 in which the metering holes in the depending wall of at least one chamber have a total surface area of S square inches and said one chamber has a volume of V gallons of water, wherein the ratio of S to V is from about 0.5 to about 2.5.

5. The method of claim 4 in which the ratio of S to V is about 1.

6. The method of claim 1 including the step of placing a porous mass of bound together fibers above the pad.

7. The method of claim 1 including the step of forming a plurality of holes through the pad for water flow therethrough.

8. The method of claim 1 in which the metering holes are formed laterally and vertically spaced apart from each other.

9. The method of claim 1 in which the metering holes are formed equidistantly spaced apart from each other around the circumference of at least one of the chambers.

10. A method as claimed in claim 1 wherein the pad and sheet are a polymeric material formed from a material based upon the same compound.

11. A method as claimed in claim 1 wherein the pad and sheet are secured together by heat sealing.

12. A method as claimed in claim 1 where at least one metering hole is located such that water flow out of the chambers is in a direction having both a horizontal component and downward component.

13. A method for forming a baffled waterbed mattress comprising the steps of:

(a) forming a baffle structure by any one of the methods of claims 1, 2, 3, 6, or 7, (b) placing the baffle structure between two outer sheets of polymeric material and bonding the two outer sheets together to form a water tight enclosure.

14. A method for forming a baffle structure for a waterbed mattress, the baffle structure comprising a laterally extending pad and a plurality of chambers depending from the pad, the method comprising the steps of:

(a) cutting a layer of buoyant polyethylene foam material to form a laterally extending pad having a length and width less than the length and width of the waterbed mattress into which the pad is to be placed, the pad being sufficiently buoyant to float freely in water; and (b) heat sealing to said pad a material constituted of polyethylene denser than water, said material having been formed to constitute chambers and having at least one hole through the walls of at least a portion of the chambers for passage of water out of the chambers, thereby to form a plurality of chambers depending from the pad, buoyant pad has sufficient buoyancy that the baffle structure floats in a waterbed mattress.

15. The method of claim 14 in which the chambers are hemi-spheroidal.

16. A method for forming a baffle structure for a waterbed mattress, the baffle structure comprising a laterally extending pad and a plurality of chambers depending from the pad, the method comprising the steps of:

(a) cutting a layer of polyethylene foam to form a laterally extending buoyant pad having a length and width less than the length and width of the waterbed mattress into which the pad is to be placed, the pad being buoyant in water;

(b) forming a plurality of holes through a sheet of polyethylene denser than water;

(c) vacuum forming the polyethylene sheet to form a plurality of chambers, there being at least one hole through the walls of at least a portion of chambers for passage of water out of the chambers; and (d) heat sealing the pad and the polyethylene sheet together with the chambers depending from the pad, wherein the buoyant pad has sufficient buoyancy that the baffle structure floats in the waterbed mattress, and in which the chambers are hemi-spheroidal.

17. The method of claim 1 in which at least a portion of the holes through the chamber walls allows passage of water out of the chambers in a direction having both a horizontal component and a downward component.

18. The method of claim 16 including the step of placing a porous mass of bound together fibers above the pad.

19. The method of claim 16 including the step of forming a plurality of holes through the pad for water flow therethrough.

* * * * *